United States Patent [19]

Ishikawa et al.

[11] Patent Number: 4,877,643

[45] Date of Patent: Oct. 31, 1989

[54] PROCESS FOR PRODUCING PREFORMED WIRE FROM SILICON CARBIDE FIBER-REINFORCED ALUMINUM

[75] Inventors: Toshikatsu Ishikawa, Tokyo; Katsuya Tokutomi, Yokosuka; Yoshikazu Imai, Tokyo, all of Japan

[73] Assignee: Director General Agency of Industrial Science and Technology, Tokyo, Japan

[21] Appl. No.: 292,465

[22] Filed: Dec. 30, 1988

[30] Foreign Application Priority Data

Mar. 24, 1988 [JP] Japan ..... 63-68100

[51] Int. Cl.[4] ..... B05D 3/12

[52] U.S. Cl. ..... 427/57; 427/434.6; 427/443.2

[58] Field of Search ..... 427/57, 434.6, 443.2

[56] References Cited

U.S. PATENT DOCUMENTS 4,717,589 1/1988 Ishikawa et al. ..... 427/57

*Primary Examiner*—Bernard Pianalto

*Attorney, Agent, or Firm*—Bucknam and Archer

[57] ABSTRACT

A process for producing a preformed wire from silicon carbide fiber-reinforced aluminum, which comprises silicon dipping a bundle of silicon carbide fibers for a period of 60 seconds or shorter in a melt of a eutectic alloy composed of aluminum and 5.0 to 7.0 wt. % of nickel added thereto which melt is kept at or below the liquidus temperature of the melting point thereof plus 50° to impregnate said fiber bundle with said alloy.

2 Claims, 1 Drawing Sheet

PROCESS FOR PRODUCING PREFORMED WIRE FROM SILICON CARBIDE FIBER-REINFORCED ALUMINUM

BACKGROUND OF THE INVENTION

1. Field of the Invention

The present invention relates to a process for producing a preformed wire from silicon carbide fiber-reinforced aluminum as an intermediate material of FRM, and particularly to a process for producing a preformed wire of the kind as described above which is prevented from deteriorating in strength at high temperatures. The concept of a preformed wire as defined in the present invention comprehends preformed sheet and tape as well.

2. Prior Art

Composite materials composed of a metal, such as aluminum, and a fibrous material, such as a silicon carbide fiber, impregnated therewith have heretofore been promising and expected as materials widely applicable to vehicles, airplanes, rockets, spacecraft, and the like by virtue of their merits respectively attributable to the metal and the fibrous material, such as toughness, lightness, and flexibility.

Various methods of producing such a metal-fiber composite material have been proposed. One example of them is a method comprising blowing fine metallic particles or a metallic vapor against a bundle of fibers by plasma jetting, metallikon, or vacuum evaporation to adhere a metal to the surfaces of the fibers to thereby produce a metal-fiber composite material or precursor thereof. However, this method is defective in that no composite material having satisfactory strength and elasticity can be obtained because fine metallic particles or a metallic vapor is so straight forward blown against a bundle of fibers that the metal cannot penetrate well into the inside of the fiber bundle.

Another proposed method comprises dipping a bundle of fibers in a molten metal bath while ultrasonically vibrating the molten metal bath to cause the molten metal to penetrate into the inside of the fiber bundle. In this case, although a bundle of fibers is opened by ultrasonic vibration to expel air present inside the fiber bundle so that the metal is allowed to penetrate well into the inside of the fiber bundle, the fibers are fixed in a disorderly opened state due to the vibration so that a difficulty is encountered in imparting desired strength and elasticity to the resulting metal-fiber composite material.

A method disclosed in Japanese Patent Laid-Open No. 34,167/1986 was proposed with a view to solving the above-mentioned problems. This method comprises spreading and arranging in order a bundle of silicon carbide fibers, and passing the bundle of silicon carbide fibers through a melt of a metal such as aluminum while ultrasonically vibrating the melt. However, this method is insufficient to prevent deterioration in strength of the resulting composite material at high temperatures. Namely, in the production of a preformed wire from silicon carbide fiber-reinforced aluminum when fibers are impregnated with an aluminum melt at a high temperature for a long period of time, an interfacial reaction occurs in the surface layers of the fibers to deteriorate the same. Some improvement can be attained against the deterioration of fibers when the melt is ultrasonically vibrated to shorten the time of impregnation for the purpose of preventing the deterioration. However, the improvement is yet insufficient. Moreover, the strength characteristics of the resulting composite material at high temperatures cannot be improved.

The present invention has been made in view of the above-mentioned state of art. An object of the present invention is to provide a process for producing a preformed wire from silicon carbide fiber-reinforced aluminum which is prevented from deteriorating in strength at high temperatures by causing aluminum to penetrate well in between the fibers at a low temperature to effect impregnation without deterioration of the fibers.

SUMMARY OF THE INVENTION

It has been found that the above-mentioned object of the present invention can be attained by treating a bundle of silicon carbide fibers in a melt of a eutectic alloy composed of aluminum and 5.0 to 7.0 wt. % of nickel added thereto which melt is kept at a specified temperature, and that such a treatment enables not only the impregnation of fibers with an alloy to be effected at a low temperature, which serves to suppress the deterioration of the fibers, but also the internal defect of a preform being produced thereby to be suppressed by virtue of a narrow temperature range for solidification of the alloy to thereby provide a high level of strength of the preform at high temperatures.

Namely, the present invention provides a process for producing a preformed wire from silicon carbide fiber-reinforced aluminum, characterized by spreading and arranging in order a bundle of silicon carbide fibers and continuously dipping the fiber bundle for a period of 60 seconds or shorter in a melt of a eutectic alloy composed of aluminum and 5.0 to 7.0 wt. % of nickel added thereto which melt is kept at or below the liquidus temperature of the melting point thereof plus 50° C. to impregnate the fiber bundle with the alloy.

DETAILED DESCRIPTION OF THE INVENTION

The present invention will now be described in detail while referring to the attached drawings.

Figure 1:
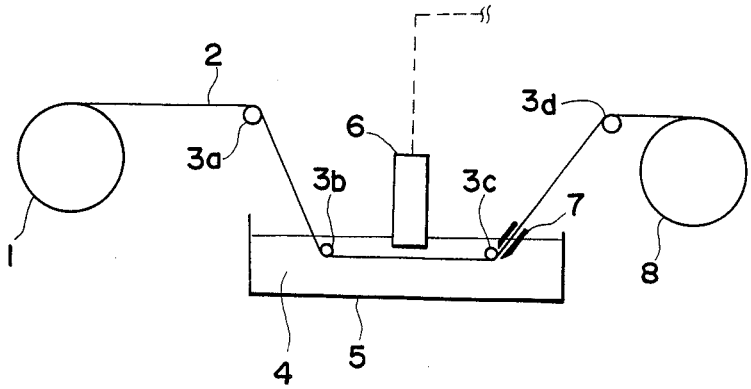
FIG. 1 is a schematic process diagram of one embodiment of the process for producing a preformed wire according to the present invention.

In FIG. 1, a bundle of silicon carbide fibers 2 spreaded and arranged in order with a fiber bundle arrangement unit 1 is introduced via guide rolls 3a and 3b into a molten alloy bath 5 filled with a molten eutectic alloy 4 composed of aluminum and 5.0 to 7.0 wt. % of nickel added thereto to impregnate the fiber bundle with the eutectic alloy.

It is desirable that the molten alloy 4 be vibrated with an ultrasonic vibrator unit 6. The ultrasonic vibration is effective in promoting the penetration of the eutectic alloy into the silicon carbide fiber bundle.

It is necessary to keep the temperature of the molten alloy bath 5 at or below the liquidus temperature of the melting point of the eutectic alloy plus 50° C. It is required that the time of dipping the silicon carbide fiber bundle 2 in the bath should be 60 seconds or shorter. When the bath temperature of the molten alloy 4 exceeds the liquidus temperature of the melting point plus 50° C. and/or when the time of dipping the silicon carbide fiber bundle 2 exceeds 60 seconds, the interfacial reaction of the surface layers of the fibers drastically proceeds to deteriorate the fibers unfavorably.

The silicon carbide fiber bundle 2 thus impregnated in an orderly arranged state with the eutectic alloy has the eutectic alloy which has well penetrated in between the fibers to have only few voids in the bundle and forming an alloy phase comprised of 0.01 to 1.0 μ fibrous eutectic phases or lamellar eutectic phases.

The silicon carbide fiber bundle 2 is then continuously drawn into a desired shape via guide rolls 3c and 3d and through a slit 7 or a die while squeezing a surplus of the alloy to form a fiber- and eutectic phase-reinforced preformed wire with a predetermined fiber content by volume, which is then, for example, wound around a wind-up unit 8. Although description has been made of the preformed wire in the present specification, the concept of a preformed wire as defined in the present invention comprehends preformed sheet and tape as described hereinbefore.

As described above, the process of the present invention is effective in that fibers can be impregnated with a eutectic aluminum alloy even at a low temperature without deterioration of the fibers to form a preformed wire of silicon carbide fiber-reinforced aluminum which undergoes no deterioration in strength even at high temperatures and has no internal defect therein in virtue of a narrow temperature range for solidification of the aluminum alloy.

DESCRIPTION OF THE PREFERED EMBODIMENTS

The present invention will now be specifically illustrated on the basis of Examples and Comparative Example.

Example 1

Figure 2:
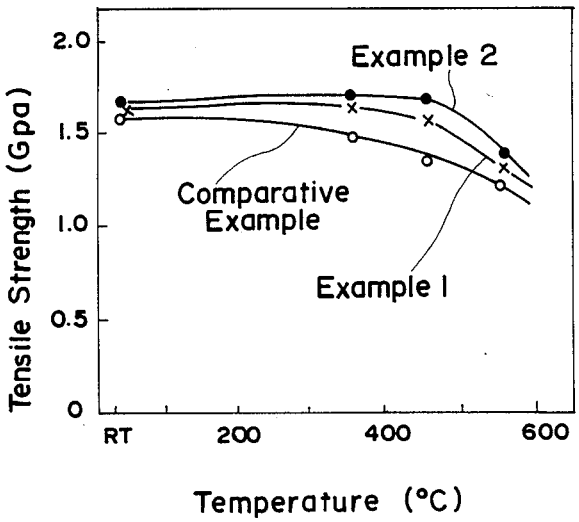
FIG. 2 is a graph showing the tensile strength versus temperature relationships in Examples 1–2 and Comparative Example.

A melt of an aluminum—5.7 wt. % nickel eutectic alloy was kept at a temperature of 670° C., higher by 30° C. than the melting point thereof. A fiber bundle of 250 silicon carbide monofilaments of 13 μ in diameter was arranged in order, opened, and continuously dipped in the melt for 10 seconds to impregnate the bundle with the aluminum-nickel eutectic alloy to thereby produce a preforme wire of 0.3 mmϕ. FIG. 2 shows the tensile strengths of this wire at various temperatures.

Example 2

A preformed wire was produced in substantially the same manner as that of Example 1 except that continuous dipping of a fiber bundle of silicon carbide monifilaments was conducted for 1 second with ultrasonic vibration of a reasonance frequency of 20 kHz. FIG. 2 also shows the tensile strengths of this wire at various temperatures.

Comparative Example

A preformed wire was produced in substantially the same manner as that of example 2 except that pure aluminum was kept as a melt at a temperature of 690° C., higher by 30° C. than the melting point thereof. FIG. 2 also shows the tensile strengths of this wire at various temperatures.

As shown in FIG. 2, the preformed wire of Comparative Example showed a tensile strength at 450° C. representing a decrease to about 90% of that at ordinary temperatures, while the tensile strengths at 450° C. of the preformed wires of Examples 1 and 2 were respectively kept at levels substantially equal to those at ordinary temperatures.

What is claimed is:

1. A process for producing a preformed wire from silicon carbide fiber-reinforced aluminum, characterized by spreading and arranging in order a bundle of silicon carbide fibers and continuously dipping said fiber bundle for a period of 60 seconds or shorter in a melt of a eutectic alloy composed of aluminum and 5.0 to 7.0 wt. % of nickel added thereto which melt is kept at or below the liquidus temperature of the melting point thereof plus 50° C. to impregnate said fiber bundle with said alloy.

2. A process as claimed in claim 1, wherein said impregnation of said fiber bundle with said alloy is effected while ultrasonically vibrating said melt.

* * * * *